United States Patent [19]

Ligouzat

[11] 4,232,973

[45] Nov. 11, 1980

[54] CONTINUOUS MIXING APPARATUS FOR FLOWABLE PRODUCTS

[75] Inventor: Pierre Ligouzat, Chavenay, France

[73] Assignee: Societe Symac, Rueil Malmaison, France

[21] Appl. No.: 4,169

[22] Filed: Jan. 17, 1979

[30] Foreign Application Priority Data

Jan. 20, 1978 [FR] France ..... 78 01670

[51] Int. Cl.[3] ..... B01F 15/02; B01F 7/08

[52] U.S. Cl. ..... 366/157; 366/165; 366/169; 366/173; 366/178; 366/293; 366/294; 366/296

[58] Field of Search ..... 366/293, 296, 295, 294, 366/268, 178, 169, 157, 178, 156, 154, 172, 150, 167, 106, 171, 173; 198/662

[56] References Cited

U.S. PATENT DOCUMENTS

| | | | |
|---|---|---|---|
| 2,298,317 | 10/1942 | Smith | 366/296 |
| 3,186,602 | 6/1965 | Ricciardi | 366/294 |
| 3,346,240 | 10/1967 | Lavelle | 366/157 |
| 3,452,965 | 7/1969 | Leister | 366/293 |
| 3,473,516 | 10/1969 | Legrain . | |
| 3,920,223 | 11/1975 | Kruger . | |
| 4,057,225 | 11/1977 | Ferree | 366/157 |
| 4,068,831 | 1/1978 | Ebeling | 366/156 |

FOREIGN PATENT DOCUMENTS 882517 11/1961 United Kingdom .

*Primary Examiner*—Robert W. Jenkins
*Attorney, Agent, or Firm*—DeLio and Montgomery

[57] ABSTRACT

To continuously mix two flowable products such as a solid product in the divided state and a liquid product, two concentric ducts are provided each with associated entraining means. The entraining means of the outer duct serves to move a first one of the flowable products along the duct from an entry port towards an exit port for the mixed products and includes a helical element urging the first product into rotation in passage along the outer duct. The second duct opens into the outer duct between the entry and exit ports of that duct and the entraining means of the inner duct serves to move the second flowable product through the inner duct and into the outer duct in the center of the first product stream.

20 Claims, 11 Drawing Figures

CONTINUOUS MIXING APPARATUS FOR FLOWABLE PRODUCTS

BACKGROUND OF THE INVENTION

1. Field of the Invention

The present invention relates to apparatus for continuously mixing flowable products and in particular, but not exclusively, to the mixing of solid products in the divided state (such as a pulverent or granular product) with liquid products.

2. Description of the Prior Art

It has been previously proposed to mix a liquid with a solid product in the divided state by drawing in the solid product jointly with the liquid product, by means of a centrifugal turbine. However, with such an arrangement mixing irregularities and an inhomogenous final product may be observed.

It has also been proposed to continuously mix solids in the divided state and liquid products by using two concentric ducts containing helical elements, but the device proposed operates only in one critical orientation and does not give a homogenous mixture of the products.

It is therefore an object of the present invention to provide an improved apparatus for continuously mixing flowable products.

SUMMARY OF THE INVENTION

According to one aspect of the invention, there is provided apparatus for continuously mixing two flowable products, the apparatus comprising a first duct having an entry port through which a first flowable product stream can pass into the first duct and an exit port through which the mixed flowable products can pass out of the first duct, first entraining means provided with a helical element and serving to impart helical motion to the first flowable product stream within the first duct, a second duct concentrically mounted within the first duct and provided with an entry port through which a second flowable product stream can pass into the second duct, the second duct being arranged to open into the first duct between the said entry and exit ports thereof to allow said second stream to pass into the first duct, and second entraining means serving to move said second flowable product stream along the second duct, the first and second entraining means being distinct from each other and serving to move the product streams in the same direction.

According to another aspect of the invention, there is provided apparatus for continuously mixing liquid products with solid products in the divided state, the apparatus comprising at least two eccentric ducts the outermost one of which is provided with an entry port through which a first product stream can pass into the duct and an exit port through which mixed products can pass out of the duct, the outermost duct being further provided with helical entraining means for urging into rotation the first product stream in passage along the duct, the or each inner duct being of smaller cross-section than the outermost duct and being provided with entraining means for moving a second product stream therealong, the or each inner duct extending into the outermost duct and opening therewithin downstream of its entry port and upstream of its exit port, the said entraining means being distinct from each other and acting on the products in the same direction.

BRIEF DESCRIPTION OF THE DRAWINGS

Several forms of apparatus for continuously mixing flowable products, each form embodying the invention, will now be particularly described by way of example, with reference to the accompanying diagrammatic drawings in which.

DESCRIPTION OF THE PREFERRED EMBODIMENTS

Figure 1:
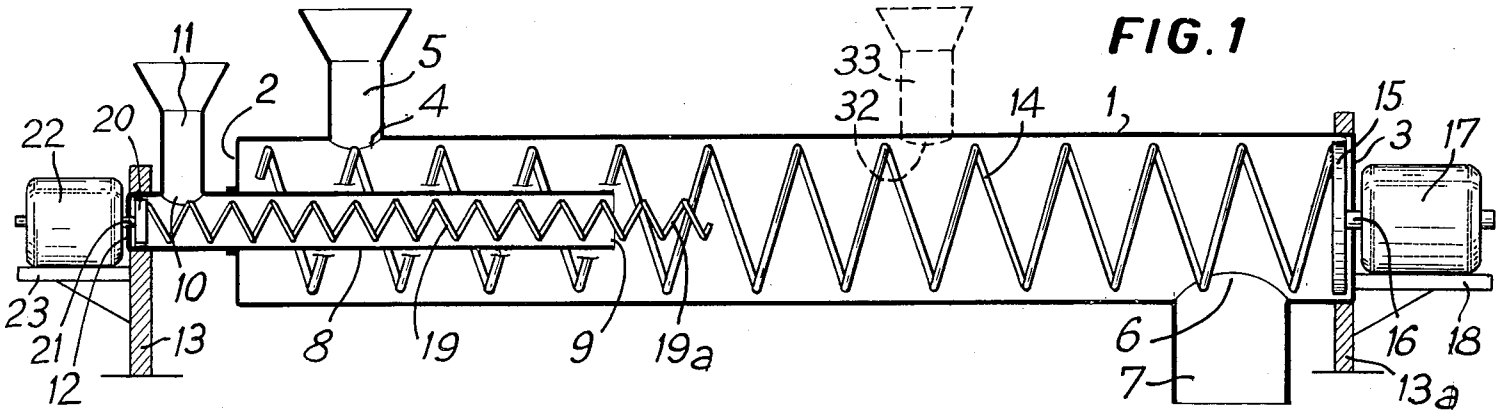
FIG. 1 is a longitudinal section of a first form of the apparatus.

The first form of the apparatus (FIG. 1) is arranged to continuously mix a liquid product with a solid product in a divided state. The apparatus comprises a first tubular duct 1 closed at both ends by bases 2 and 3 and provided adjacent one end with an entry port 4 through which liquid product supplied through a supply pipe 5 and constituting a first flowable product stream can pass into the first duct 1. Adjacent the other end of the duct 1 is situated an exit port through which the mixed solid and liquid products can pass out of the duct 1 into a discharge duct 7.

A second tubular duct 8 of smaller cross-section than the first duct 1 is concentrically mounted therewithin to protrude through the base 2. The end opening 9 of the duct 8 lying within the duct 1 opens into the duct 1 between the entry port 4 and exit port 6 of the duct 1, that is, downstream of the port 4 and upstream of the port 6.

The end opening of the second tubular duct 8 lying outside the duct 1 is closed by a base 12. Adjacent the base 12, the duct 8 is provided with an entry port 10 through which solid product in the divided state (in particular a pulverent or granular product) can pass from a pipe 11 into the second duct 8; the solid product constitutes a second flowable product stream.

The nest of tubular ducts 1 and 8 thus formed is mounted on supporting or frame elements 13,13*a*.

A helical wire element or spring 14 is rotatably mounted within the first duct 1 and is secured at one end to a plate 15 integral with a spindle 16 of drive means 17. The drive means rests on a supporting member 18 rigid with the frame element 13*a*. The helical element 14 and drive means 17, form first entraining means serving to move the liquid product helically through the first duct 1.

In similar manner, a helical wire element or spring 19 is rotatably mounted within the second tubular duct 8 and is secured to one end to a plate 20 integral with a spindle 21 of drive means 22. The drive means 22 rests on a supporting member 23 rigid with the frame element 13. The helical element 19 and drive means 22 form second entraining means serving to move the solid product through the second duct 8.

At its end remote from the plate 20, the helical element 19 is free and has a portion 19*a* which extends a short distance through the opening 9 of the tubular duct 8 into the first duct 1.

The helical elements 14 and 19 are of opposite hands and are driven in rotation in opposite senses by the drive means 17 and 22, so that the elements 14 and 19 act on the products to move them in the same direction. Instead of being independently driven, the elements 14 and 19 may be jointly rotated in the same sense by a single drive means in which case the elements are of the same hand.

Although the ducts 1 and 8 are illustrated as horizontal in the drawings, it is obviously possible to arrange them otherwise, for example vertically, although the horizontal orientation is preferred.

The operation of the first form of the apparatus will now be described.

The liquid product which is fed into the first tubular duct 1 via the port 4 is entrained in rotation and centrifuged by the helical element 14 driven by the drive means 17.

When the rotation of the liquid product is stabilised in the tubular duct 1, the solid product is fed into the second tubular duct 8 via the port 10 and is entrained in rotation and moved along the duct 8 by the helical element 19 to flow via the opening 9 into the tubular duct 1 where it is mixed with the liquid product.

The second tubular duct 8 in addition to providing a passage through which the solid product is conveyed, also serves to form with the duct 1 a passage of annular cross-section for liquid product entering the tubular duct 1, and this facilitates the setting in rotation of the liquid.

The helical elements 14 and 19 enable the solid product stream to be conveyed to the centre of the liquid product stream while these streams are simultaneously rotated in oppisite senses.

The portion 19*a* of the helical element 19 serves to increase the zone of entrainment in rotation of the solid product and also improved is diffusion into the liquid stream.

The mixture of solid and liquid products is entrained by the helical element 14 and moved towards the port 6 where it is discharged into the duct 7.

When the quantity of liquid to be mixed with the solid product is very substantial, a small part only of the liquid is fed into the duct 1 via the entry port 4 to produce a premixing action abreast of the outlet opening 9 of the second duct 8. The remainder of the liquid (which is the greater part) is fed into the duct 1 via a second entry port 32 via a pipe 33 (both the port 32 and pipe 33 are illustrated by dashed lines in FIG. 1).

The second entry post 32 of the pipe 33 is situated downstream of the opening 9 of the second duct 8 and upstream of the mixture discharge port 6.

One embodiment of the first form of the apparatus has been experimentally used to produce a pancake mixture from flour, milk powder, vitamins, oil, water and eggs. In this apparatus the first tubular duct 1 has an internal diameter of 80 mms and is arranged to receive the oil, water and eggs. The first helical element is in the form of a 7 mm guage wire spring with an outer diameter of 70.5 mms and a left-hand pitch of 65 mms which is arranged to be rotated at 1500 r.p.m.

The second duct 8 serves to convey into the first duct 1 the solid products constituted by the flour, milk powder and vitamins. The duct 8 has an internal diameter of 44 mms. The second helical element 19 is formed by a 5 mm guage wire spring having an outer diameter of 34 mms with a right hand pitch of 30 mms. The element 19 is arranged to be rotated at between 1000 and 1500 r.p.m.

This particular apparatus has also been used to product a sound-proofing product formed by liquid bitumen and a solid such as asbestos.

Figure 2:
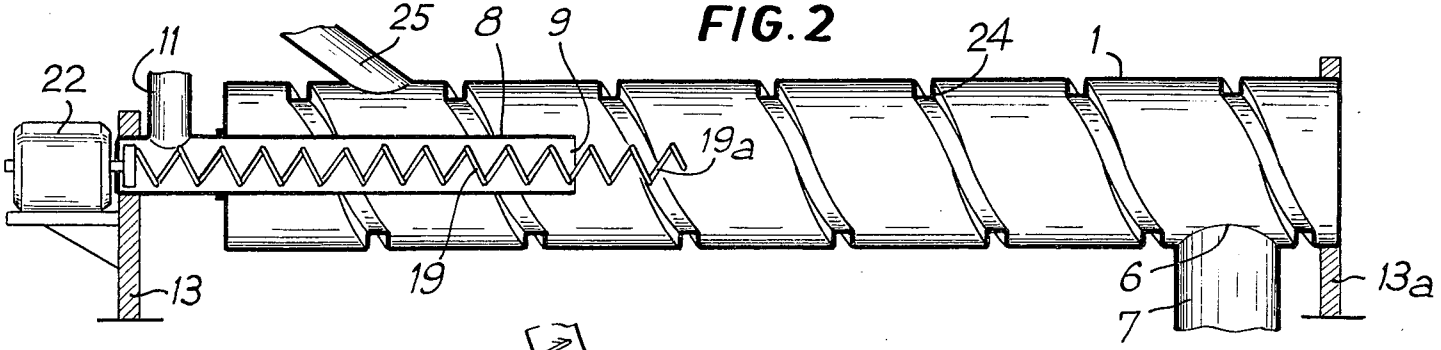
FIG. 2 is a longitudinal section of a second form of the apparatus.

In the second form of the apparatus (FIG. 2) the rotary helical element 14 of the first form of the apparatus has been replaced by a stationary helical element 24 formed by a projecting fin or strip provided around the wall of the first duct 1.

The liquid product is injected tangentially into the duct 1 under high pressure via an angled pipe 25 in such manner as to impart to the liquid a helical motion comparable to that which would be imparted to it by the helical element 14. The first entraining means thus comprises the angled pipe 25 and the element 24.

The arrangement of the second tubular duct 8 and the helical element 19 is the same as in the first form of the apparatus.

Figure 3:
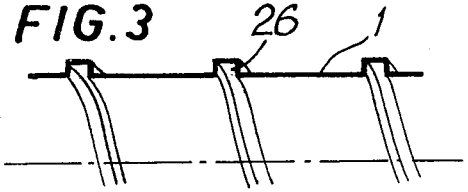
FIG. 3 is a longitudinal section of part of a modified form of liquid duct of the FIG. 2 apparatus.

The second form of the apparatus can be modified as illustrated in FIG. 3 by forming the stationary helical element as a helical groove 26 provided in the wall of the duct 1.

Figure 4:
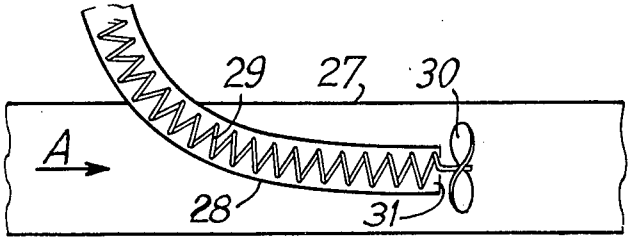
FIG. 4 is a longitudinal section of a third form of the apparatus.

The third form of the apparatus (FIG. 4) comprises a first tubular duct 27 along which the liquid product is displaced in the direction of the arrow A, and a second duct 28 having one end portion arranged concentrically within the duct 27 and through which solid product in the divided state is moved by the action of a helical element 29.

The helical element 29 is integral with a helical propeller 30 positioned close to the outlet opening 31 of the duct 29. Under the action of the displacement of the liquid along the duct 27 the propeller 30 is forced to rotate which causes the liquid in the space upstream of the propeller 30 also to rotate. Rotation of the propeller 30 also causes the helical element 29 to rotate to convey the solid product into the duct 27. Solid product emerging from the outlet opening 31 is continually cleared by the action of the propeller 30.

Figure 5:
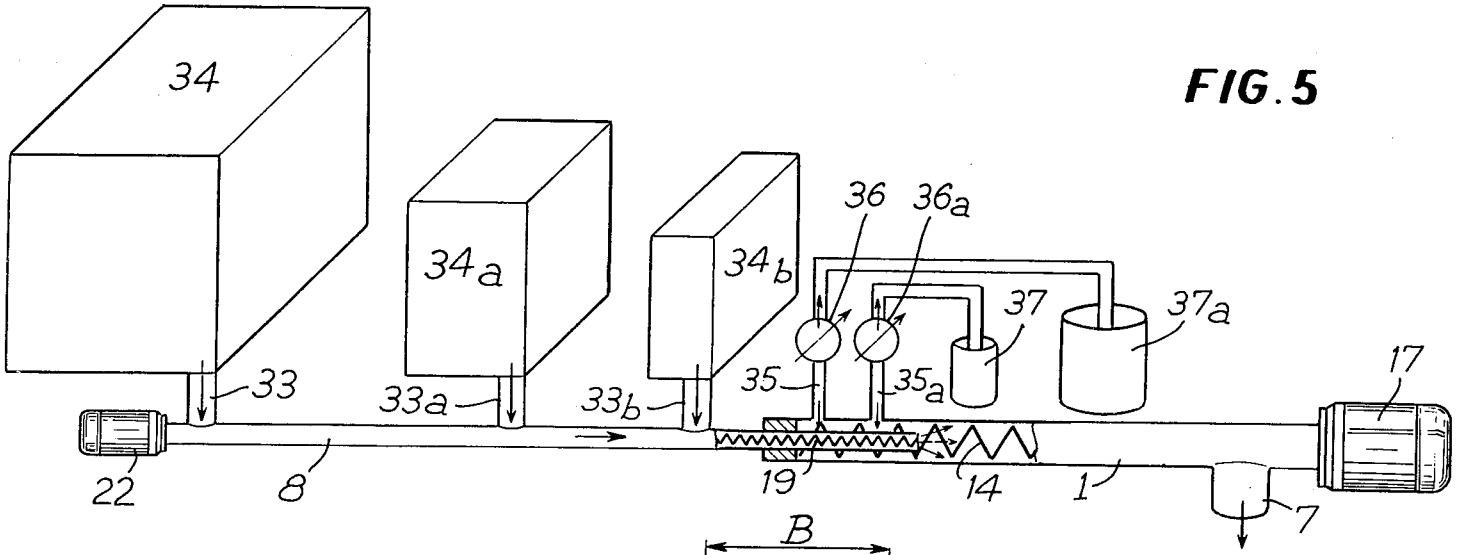
FIG. 5 is a diagram of a plant incorporating the first form of the apparatus.
Figure 6:
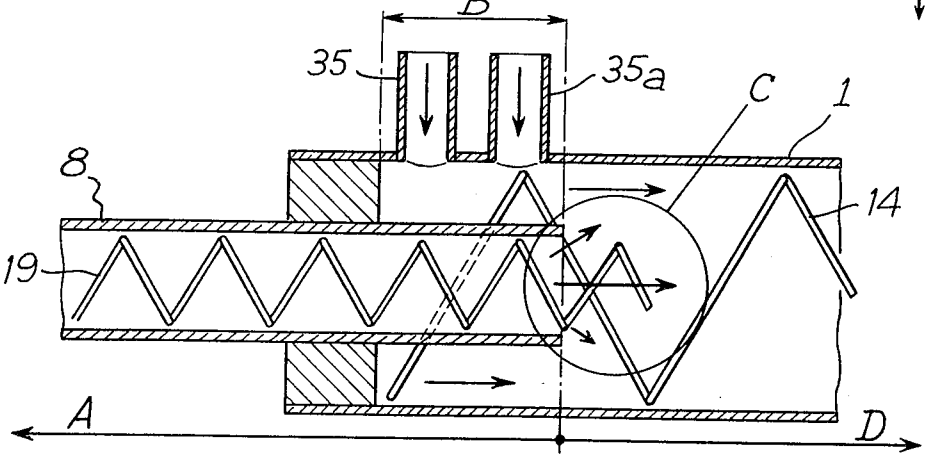
FIG. 6 is a detail view illustrating the operation of the mixing apparatus.

Illustrated in FIG. 5 is a mixing plant which incorporates mixing apparatus of the FIG. 1 form with the second duct 8 being supplied with different solid products in the divided state via several pipes 33,33*a*,33*b* from metering appliances 34,34*a*,34*b*. The different metered solid products are mixed within the duct 8 during their displacement under the action of the helical element 19 as far as the opening 9, that is within zone A (FIG. 6).

The duct 1 is supplied with liquid upstream of the outlet opening 9 of the duct 8, via two pipes 35 and 35*a* provided with respective metering pumps 36 and 36*a*. The pipes 35 and 35*a* are fed from tanks 37 and 37*a* which contain different liquids. The mixing of the two liquids is performed in the duct 1 upstream of the outlet opening 9 of the duct 8 by placing them in centrifuged motion within zone B (FIG. 6). This centrifuging action is due to the rotation of the helical element 14 which causes a vortex action.

The mixed solid products are injected and diffused at the centre of the vortex in zone C. The direction of diffusion of the solid products is reversed as compared to the direction of the vortex, which facilities almost instantaneous mixing of the solid and liquid product and prevents clotting or the forming of any agglomerate.

Finally, homogenisation of the mixture and its transfer towards the pipe 7 occur in zone D.

In the forms of the apparatus so far described, the liquid product has been fed in via the outer duct and the solid product via the inner duct; it will, however, be appreciated that the reverse procedure could be adopted, that is, the liquid product could be fed in via the inner duct 8 and the solid product via the outer duct 1.

In the greater proportion of cases, it has been found to be advantageous to feed the liquid into the outer duct, but in particular cases (for example, the humidification of solid products in the divided state) it may be preferable to feed in the liquid in small quantities via the inner duct using any suitable entraining means.

Figure 7:
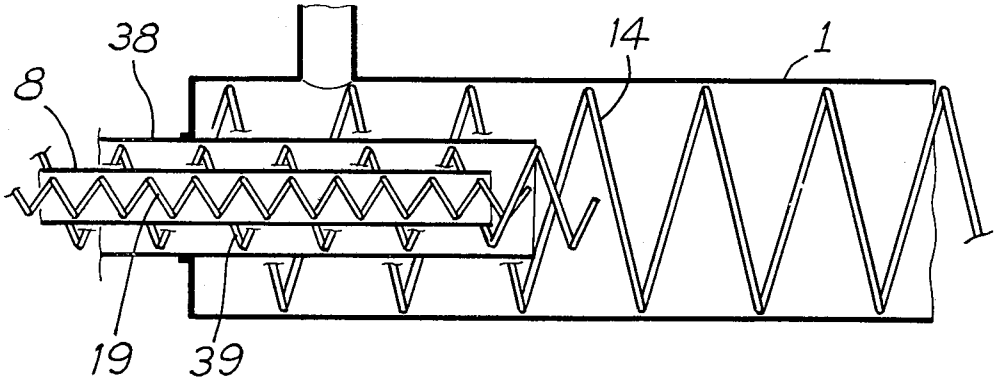
FIG. 7 is a longitudinal section of a fourth form of the apparatus.

In the fourth form of the apparatus (FIG. 7), the first duct 1 accommodates two coaxial second ducts 8 and 38 which are respectively provided with helical elements 19 and 39 serving to impell two solid or liquid products into the duct 1 which is itself fed with a solid or liquid product.

Figure 8:
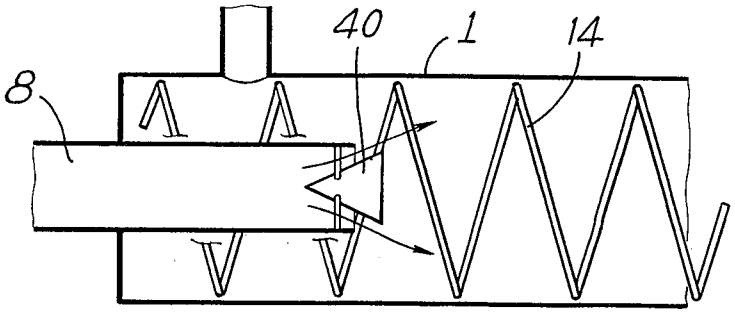
FIG. 8 is a longitudinal section of a fifth form of the apparatus.

In the fifth form of the apparatus (FIG. 8), the second duct 8 is not provided with a helical entraining member, but liquid or solid product is conveyed therealong in suspension in a pulsed gas stream. The opening of the duct 8 which leads into the duct 1 is equipped with a deflector 40 directing the gas-conveyed product towards the walls of the duct 1.

It will be appreciated that the gas supply means forms the second entraining means of the apparatus and the gas is mixed intimately with the two other products. Apparatus of this form could also be used to produce a mixture of a gas and a solid or of a gas and a liquid (the gas then being considered as forming one of the flowable product streams to be mixed).

Figure 9:
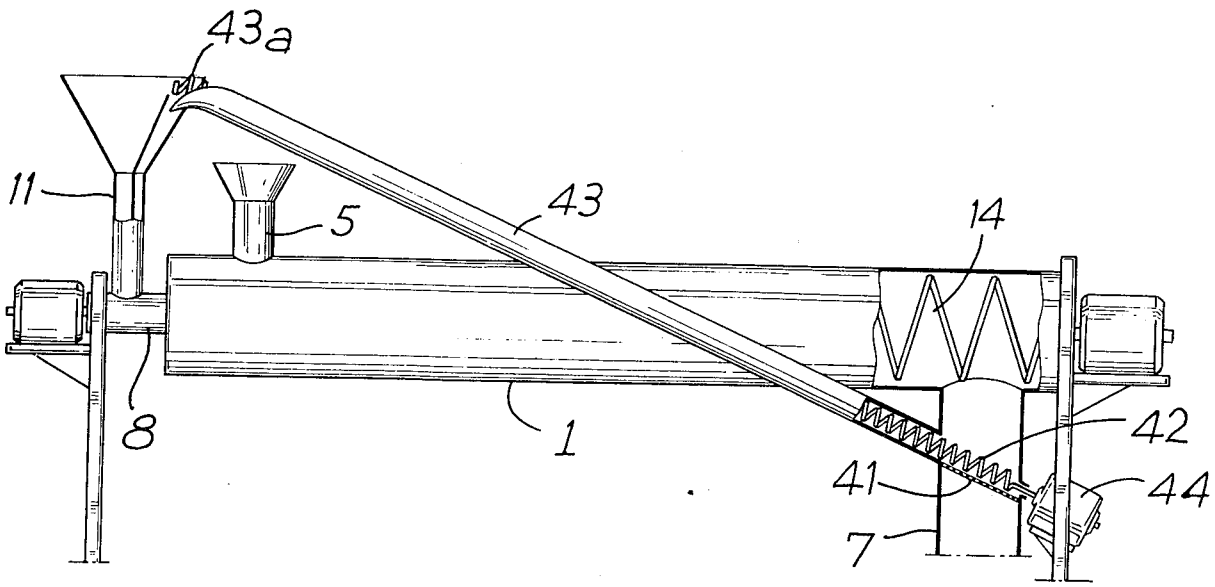
FIG. 9 is a diagrammatical view of the first form of the apparatus modified to provide for the circulation of small spheroids therethrough.
Figure 10:
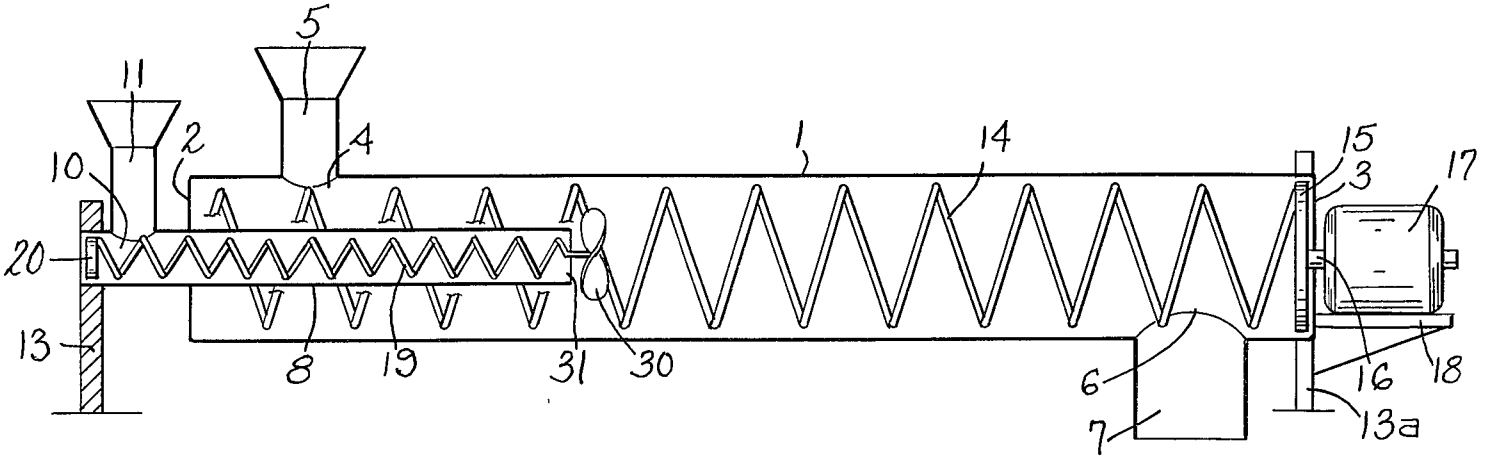
FIG. 10 is a longitudinal section of an alternate form of the apparatus.
Figure 11:
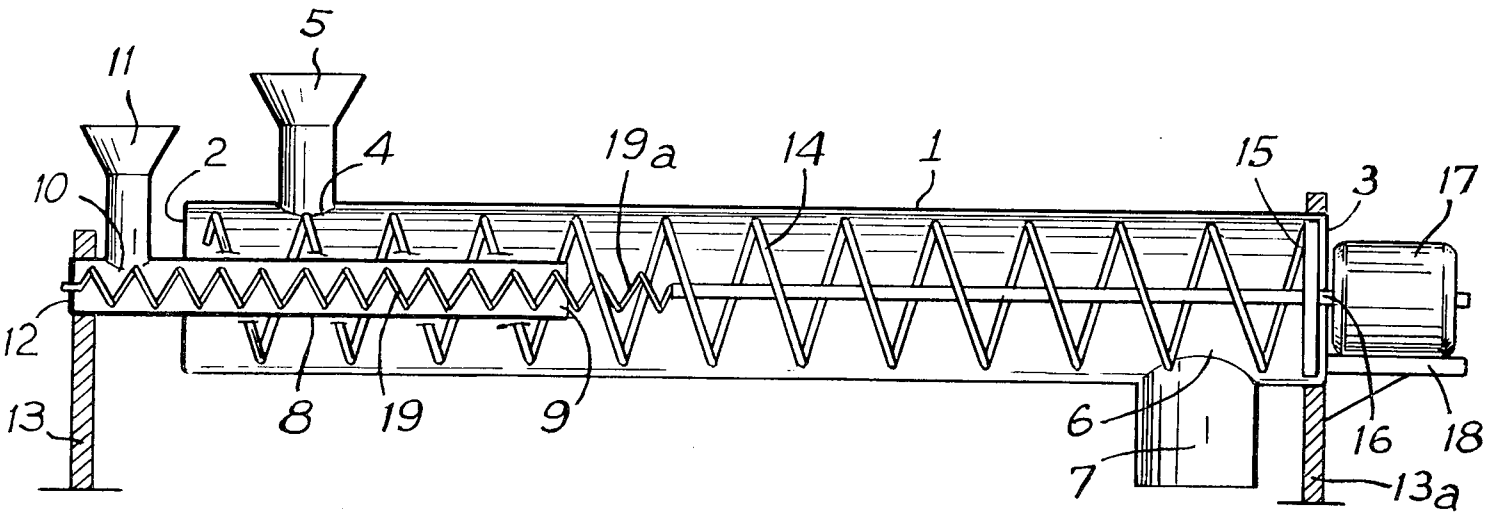
FIG. 11 is a longitudinal section of an alternate form of the apparatus.

FIG. 9 illustrates a version of the first form of the apparatus modified to provide for circulation through the apparatus of small spheroids of a solid material having a greater hardness than the solid product to be mixed. These spheroids serve to improve the comminutive and/or dispersive action of the solid product within the liquid product and are fed into the solid product supply pipe 11.

A sloping grid 41 is installed within the mixture outlet port 7 to enable the small spheroids to be recovered, the mixture passing through the grid orifices. Above the grid 41 is situated a conveyor element comprising a helical transfer member 42 arranged in a tubular duct 43 and rotated by a drive 44. The tubular duct 43 opens at 43*a* into a partitioned-off section of the duct 11 to reach the duct 8 with the solid product.

The small spheroids in conjuction first with the element 19 and then with the element 14 effect a crushing action of the solid product.

The described forms of mixing apparatus makes it possible to process considerable quantities of flowable products (in particular, solid or liquid products) in a continuous manner and to obtain a homogenous resultant mixture.

Instead of mixing the flowable products mass against mass, which requires considerable power and time, the described apparatus effects jet against jet mixing, which is much easier. When mixing solids and liquids, each particle of solid product encounters a liquid particle with which it is to be mixed, very rapidly.

The described forms of apparatus are advantageous in that the formation of agglomerates or clots is substantially avoided because as solid products are fed in radially at high speed into the centrifuged liquids, a thorough mix is produced practically instantaneously.

It is to be noted that the first and second entraining means are distinct from each other in all the described forms of apparatus.

The industrial applications of the described apparatus are numerous and varied.

The following applications, for example, are envisaged in the food industries: continuous production of dough (or mixture) for rissoles, paste for coating deep-frozen products, pancake mix, sponge-cake mix, bread dough, Bechamel sauce, composite fodder for cattle, liquid milk enrighment, wheat grain coating, introduction of flavours, and production of syrups.

In the chemical industries, it is possible to envisage application, amongst others: in the production of acrylic cement, paper glues, synthetic adhesives, coating of polystyrene spheroids for insulating partitions, production of mortar, enrichment of kerosene, and production of bituminous coatings, paints, varnishes, and ceramics.

I claim:

1. Apparatus for continuously mixing two flowable products, the apparatus comprising a first duct having an entry port through which a first flowable product stream can pass into the first duct and an exit port through which the mixed flowable products can pass out of the first duct, first entraining means provided with a helical element and serving to impart helical motion to the first flowable product stream within the first duct, a second duct concentrically mounted within the first duct and provided with an entry port through which a second flowable product stream can pass into the second duct, the second duct being arranged to open into the first duct between the said entry and exit ports thereof to allow said second stream to pass into the first duct, and second entraining means serving to move said second flowable product stream along the second duct, the first and second entraining means being distinct from each other and serving to move the product streams in the same direction.

2. Apparatus according to claim 1, in which the second entraining means comprises a helical element installed within the second duct.

3. Apparatus according to claim 2, in which the helical elements of the first and second entraining means are of opposite hands and are arranged to be rotated in opposite senses by drive means of said entraining means.

4. Apparatus according to claim 2, in which the helical elements of the first and second entraining means are of the same hand, and are arranged to be rotated in the same sense by common drive means of the entraining means.

5. Apparatus according to claim 2, in which the first entraining means includes injection means arranged to inject said first flowable product in the form of a liquid into the first duct, the apparatus further comprising means arranged to supply said second flowable product in the form of a solid in a divided state into the second duct.

6. Apparatus according to claim 5, in which said liquid injection means in arranged to inject liquid tangentially into the first duct.

7. Apparatus according to claim 6, in which the helical element of the first entraining means is formed by a stationary helical element provided within the first duct, the second entraining means comprising its said helical element and drive means for rotating that element.

8. Apparatus according to claim 7, in which the stationary helical element is formed by a helical strip projecting inside the first duct.

9. Apparatus according to claim 7, in which the stationary helical element is formed by a helical groove provided internally around wall means defining the boundary of the said duct.

10. Apparatus according to claim 5, in which the helical element of the first entraining means is formed by a propeller disposed within the first duct adjacent the second duct and fast with the helical element of the second entraining means whereby this latter element is caused to rotate as a consequence of the action upon the propeller of the liquid injected into the first duct by said injection means.

11. Apparatus according to any one of claims 2, 3, 4, 5, 6 or 7, in which the helical element installed within the second duct extends out of the second duct into the first duct.

12. Apparatus according to claim 1, in which the first duct is further provided with a second entry port downstream of where the second duct opens into the first duct.

13. Apparatus according to claim 1, in which the first duct is supplied with flowable products via a plurality of pipes each opening into the duct upstream of the opening of the second duct into the first duct, the said pipes being provided with metering devices.

14. Apparatus according to claim 1 or claim 5, in which the second duct is supplied with flowable products via a plurality of pipes distributed over its length and each provided with a metering device.

15. Apparatus according to claim 1, in which a plurality of second ducts are provided leading into the first duct.

16. Apparatus according to claim 1, in which the second entraining means comprises means arranged to supply a pulsed stream of gas to the second duct.

17. Apparatus according to claim 16, in which a deflector element is provided where the second duct opens into the first duct.

18. Apparatus according to claim 1 and arranged to mix a flowable solid product supplied to its second duct with another flowable product, the apparatus including spheroids of a greater headness than the solid product, and means arranged to feed the spheroids into the second duct together with the solid product.

19. Apparatus according to claim 18, in which a grid is provided in the path of mixture leaving the exit port of the first duct, said grid serving to recover the spheroids to enable their recycling back to the second duct.

20. Apparatus for continuously mixing liquid products with solid products in the divided state, the apparatus comprising at least two concentric ducts the outermost one of which is provided with an entry port through which a first product stream can pass into the duct and an exit port through which mixed products can pass out of the duct, the outermost duct being further provided with helical entraining means for urging into rotation the first product stream in passage along the duct, the or each inner duct being of smaller cross-section than the outermost duct and being provided with entraining means for moving a second product stream therealong, the or each inner duct extending into the outermost duct and opening therewithin downstream of its entry port and upstream of its exit port, the said entraining means being distinct from each other and acting on the products in the same direction.

* * * * *